United States Patent [19]

Gorin

[11] 4,191,538

[45] Mar. 4, 1980

[54] SYNTHETIC $CO_2$ ACCEPTOR AND GASIFICATION PROCESS THEREWITH

[75] Inventor: Everett Gorin, San Rafael, Calif.

[73] Assignee: Continental Oil Company, Stamford, Conn.

[21] Appl. No.: 20,003

[22] Filed: Mar. 12, 1979

[51] Int. Cl.[2] ..... C10J 3/00; C10J 3/54

[52] U.S. Cl. ..... 48/197 R; 252/373; 252/443; 252/455 R; 423/230

[58] Field of Search ..... 48/197 R, 202; 252/373, 252/443, 455 R; 423/230

[56] References Cited

U.S. PATENT DOCUMENTS

| | | | |
|---|---|---|---|
| 2,442,191 | 5/1948 | Black | 252/455 R |
| 2,456,072 | 12/1948 | Marisic | 252/455 R |
| 3,115,394 | 12/1963 | Gorin et al. | 48/202 |
| 3,194,644 | 7/1965 | Gorin et al. | 48/202 |

OTHER PUBLICATIONS $CO_2$ Acceptor Process Pilot Plant, Fink et al., Papers Clean Fuels From Coal Symposium II, IGT, pp. 243–257, 1975.

*Primary Examiner*—Richard V. Fisher
*Assistant Examiner*—Peter F. Kratz
*Attorney, Agent, or Firm*—F. Lindsey Scott; William A. Mikesell, Jr.

[57] ABSTRACT

A synthetic $CO_2$ acceptor comprising at least one compound selected from the group consisting of calcium oxide and calcium carbonate supported in a refractory carrier matrix of the general formula $3CaO(SiO_2)_x(Al_2O_3)_{1-x}$ wherein x is from about 0 to about 1.0.

6 Claims, 1 Drawing Figure

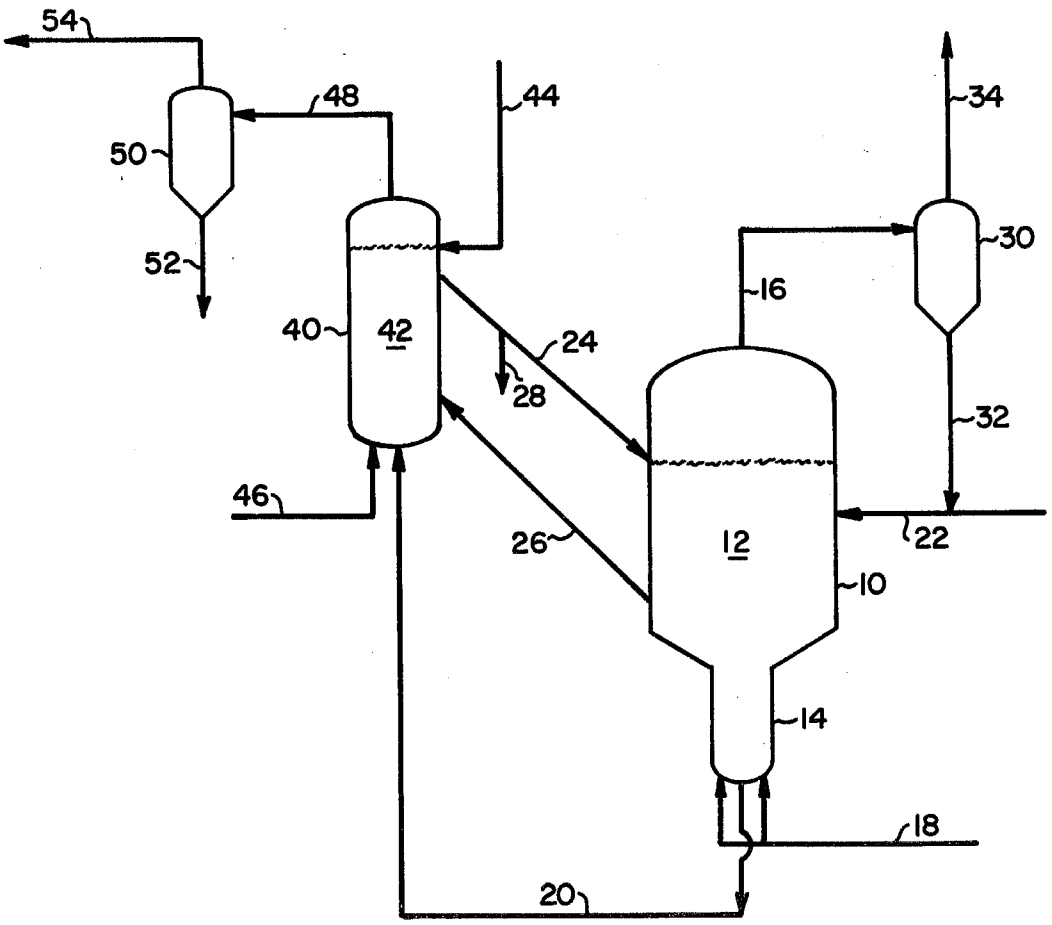
34
30
32
22
10
18
16
12
14
24
28
26
20
44
42
48
40
46
50
52
54

SYNTHETIC $CO_2$ ACCEPTOR AND GASIFICATION PROCESS THEREWITH

This invention resulted from work done pursuant to a contract with the Energy Research and Development Administration (now Department of Energy).

This invention relates to synthetic $CO_2$ acceptors for use in processes wherein steam and carbonaceous fuels are reacted in the presence of calcium oxide to produce gaseous products and calcium carbonate.

In view of the continuing and well-known shortage of natural gas and similar fuels, a continuing effort has been directed to the development of methods whereby synthetic natural gas and other substitutes for naturally-occurring gaseous fuels can be produced from coal and other solid carbonaceous fuels. One such method has been the direct reaction of steam with carbonaceous fuels such as coal, coke and the like in the presence of calcium oxide to produce gaseous products which are rich in hydrogen and calcium carbonate. Some processes of this type are disclosed in United States Patents:

| | |
|---|---|
| U.S. 2,654,661 | Gorin |
| 2,654,662 | Gorin |
| 2,654,663 | Gorin |
| 2,682,455 | Gorin |
| 2,682,456 | Gorin |
| 2,682,457 | Gorin |
| 2,705,672 | Gorin |
| 2,781,248 | Gorin |
| 2,807,529 | Tarbox |
| 3,108,857 | Gorin et al. |
| 3,115,394 | Gorin et al. |
| 3,188,179 | Gorin |
| 3,194,644 | Gorin et al. |
| 3,516,808 | Curran et al. |

These references are hereby incorporated in their entirety.

Further references considered in the preparation of the subject application are as follows:

| | |
|---|---|
| U.S. 1,574,380 | Endres |
| 2,057,402 | Tropsch |
| 2,234,367 | Chesny |
| 3,141,729 | Clarke |
| 3,847,837 | Boryta |
| 3,865,924 | Gidaspow |

In the practice of such processes, it has been found that upon regeneration of the calcium carbonate by heating to produce calcium oxide that over a period of time, the calcium oxide becomes relatively inert and ineffective as a carbon dioxide acceptor in the reaction zone. While the reasons for this inactivity are varied, at least one major cause is the growth of the crystal size of the calcium oxide as a result of thermal treatment in the calcining of the calcium carbonate to calcium oxide, repeated contact with steam and the like. The net result is a need to regenerate or replace the calcium oxide periodically. Since the replacement of this material is time-consuming and relatively expensive, a continuing effort has been directed to the development of synthetic $CO_2$ acceptors which offer a longer life and do not require regeneration at the frequency required by the naturally-occurring calcium oxide. In accordance with the present invention, a synthetic acceptor is provided which consists essentially of at least one calcium compound selected from the group consisting of calcium oxide and calcium carbonate supported in a porous refractory carrier matrix which is chemically inert to lime (CaO). Suitable carriers are defined by the general formula $$3CaO(SiO_2)_x(Al_2O_3)_{1-x}$$

where x is from about 0 to about 1.0, although the carrier may also contain minor amounts of other refractory materials such as MgO and the like.

The FIGURE is a schematic process flow sheet of a process for the production of hydrogen-rich gaseous fuels by the reaction of steam with carbonaceous fuels in the presence of calcium oxide.

A reactor 10 wherein steam is reacted with carbonaceous fuels in the presence of calcium oxide is shown. Reactor 10 contains a fluidized bed of char 12 and includes a standpipe 14 which comprises a section of reduced diameter positioned on the lower portion of reactor 10. Fluidized bed 12 is maintained in a fluidized condition by the injection of a fluidizing gas through line 18. The fluidizing gas is primarily steam and is injected in an amount sufficient to maintain bed 12 in a fluidized condition and to result in the recovery of calcium carbonate from standpipe 14 through line 20. Fuel such as coal, char or the like is introduced into reactor 10 via a line 22 and regenerated $CO_2$ acceptor, i.e. calcium oxide, is introduced into reactor 10 via a line 24. A stream of char is removed from fluidized bed 12 via a line 26 and passed to a second fluidized bed 42 which is described in greater detail hereinafter. The product gas recovered from reactor 10 flows through a line 16 to a solids/gas separator such as a cyclone 30 where solids are separated from the gaseous mixture which is recovered through a line 34 with the recovered solids being passed through a line 32 back to feed inlet 22 for return to reactor 10. The calcium carbonate recovered from vessel 10 via line 20 is passed to a regenerator 40 which comprises a fluidized bed 42 of calcium compounds wherein the calcium carbonate is calcined to calcium oxide. Heat is provided in fluidized bed 42 by the injection of a fluidizing gas which contains free oxygen which burns the char passed to fluidized bed 42 from reactor 10. The flow of oxygen is controlled to provide an amount of heat sufficient to maintain the temperature in fluidized bed 42 at a desired level. The stack gases recovered from regenerator 40 are the combustion products resulting from the combustion of char to produce the heat required in regenerator 40 and in addition contain a major portion of the ash produced by the combustion of coal in reactor 10. The ash is desirably separated from the gaseous mixture by suitable gas/solids separation means such a cyclone 50 with the flue gas being passed to exhaust or the like via a line 54 and the ash being passed to waste disposal or the like via a line 52. Fresh $CO_2$ acceptor such as calcium oxide, calcium carbonate or mixtures thereof is added to the system at any convenient location and is shown via a line 44 charging fresh calcium compounds to regenerator 40. The fresh acceptor could conveniently be added to line 24, vessel 10, line 20 or the like. Spent acceptor is conveniently withdrawn in a similar fashion and is shown withdrawn via a line 28 from line 24. In the operation of the process depicted schematically in the FIGURE, steam is injected in an amount and at a pressure sufficient to result in a steam pressure up to about 13 atmospheres in standpipe 14. Reactor 10 typically operates at a temperature less than about 1550° F., desirably from about 1475° to about 1575° F. and, as indicated previously, the calcium carbonate produced in reactor 10 is recovered from standpipe 14 and passed to regenerator 40 which typically operates at a temperature in exess of about 1800° F. The operation of such processes has been described in the references set forth hereinbefore and is considered to be known to those skilled in the art. As is known to those skilled in the art, the reactions occurring in vessel 10 can be summarized as follows:

$$C+H_2O \rightarrow CO+H_2 \quad (1)$$

$$C+2H_2O \rightarrow CO_2+2H_2 \quad (2)$$

$$CaO+CO_2 \rightarrow CaCO_3 \quad (3)$$

As is known to those skilled in the art, a variety of other reactions also occur in the reaction vessel, such as, for instance $$CO+3H_2 \rightarrow CH_4+H_2O \quad (4)$$

$$CaO+H_2S \rightarrow CaS+H_2O \quad (5)$$

Further, the water/gas shift reaction tends to occur to produce additional hydrogen. The reaction of the calcium carbonate and carbon dioxide liberates substantial quantities of heat which is required to sustain the reaction of carbon with steam. Since substantial quantities of carbon dioxide are removed from the reaction zone, the synthesis gas mixture so produced is rich in methane and, particularly, is rich in hydrogen since the removal of the $CO_2$ tends to result in a substantial shifting of the equilibrium composition to hydrogen.

At least partially as a result of the continuing contact of the calcium carbonate with steam, especially in standpipe 14, portions of the calcium oxide-calcium carbonate tend to grow in crystal size and become relatively inert. The net result is particles of calcium oxide which have very low surface area and react slowly if at all in reactor 10. Such calcium oxide is considered to be inactive and requires regeneration to be effective in the process reactions. It has been necessary to remove such inactive material periodically and replace it with fresh calcium oxide or calcium carbonate to maintain suitable reactivity in the process.

In accordance with the present invention, a synthetic acceptor is provided. The synthetic acceptor of the present invention comprises, in essence, a thermally stable inert matrix which is a porous refractory carrier which is substantially inert to lime and the high temperature steam environments encountered in the process discussed above. Chemically-free calcium compounds are supported in the porous matrix as discussed more fully hereinafter. The use of the synthetic acceptor of the present invention permits the use of higher steam pressures, i.e. in excess of 13 atmospheres in standpipe 14, since the synthetic acceptor of the present invention is readily regenerated by the formation of a relatively low melting eutectic mixture of calcium oxide, calcium hydroxide and calcium carbonate which forms in the presence of steam. The calcium compounds, i.e. calcium oxide, calcium carbonate or mixtures thereof, of the synthetic acceptor are held within the refractory matrix by surface tension or the like so that the calcium compounds are at least partially liquefied as the synthetic acceptor passes through the process, thereby regenerating the synthetic acceptor with each passage through the process.

Desirably, the chemically uncombined calcium compound is present in the synthetic acceptor in an amount equal to from about 10 to about 20 weight percent calculated as calcium oxide equivalent based on the weight of the acceptor, i.e. about 10 to about 20 weight percent CaO in addition to any calcium contained in the carrier. The synthetic acceptor of the present invention is suitably prepared as follows.

An intimate mixture of finely ground powders is prepared having the composition $3CaO(SiO_2)_x(Al_2O_3)_{1-x}$. An additional amount of CaO is then mixed with the above composition so that after firing it contains from 10 to 20 weight percent of free chemically uncombined CaO. The mixture is pressed into pellets, preferably with addition of 10 to 15 weight percent of finely divided carbon. The pellets are calcined for from 1 to 20 hours at 1200°-1500° C. with final removal of the carbon by combustion. The purpose of the carbon is to provide both heat and porosity to the resultant fired product.

The free CaO in the resulting product is converted to $CaCO_3$ by exposure to 13-20 atmospheres of steam plus 1 atmosphere of carbon dioxide at 650° to 875° C. for 1 to 5 hours.

Alternatively, the synthetic acceptor preparation is varied as follows. The method above is followed except that the free CaO is added only after the inert matrix has been fired. The active CaO is added by impregnation with a water-soluble calcium salt which yields CaO and/or $CaCO_3$ by thermal decomposition. Suitable examples of such salts are calcium nitrate, calcium formate or calcium acetate (i.e. $Ca(NO_3)_2$, $Ca(OOCH)_2$ and $Ca(OOCCH_3)_2$ and the like.

Finally, it would be desirable to prepare a dual pore pellet such that the free CaO is retained within the fine pore inner part of the pellet with the outer layer of the pellet containing coarse pores and little free CaO. Such construction would protect the free lime in the pellet from interaction with char, ash and the like at the pellet exterior.

The use of the synthetic acceptor of the present invention permits an improvement in the operation of reactor 10 whereby a higher steam pressure is used in standpipe 14 to result in the regeneration of the synthetic acceptor with each passage through the process. As indicated, when the synthetic acceptor of the present invention is contacted with steam at a pressure greater than 10 atmospheres and a temperature in excess of 1200° F. after at least a portion of the calcium oxide has reacted to produce calcium carbonate, a low melting eutectic compound forms which permits the liquefaction of the calcium compound to permit regeneration of the synthetic acceptor with each passage through the process. Desirably, the steam contacting in standpipe 14 is at a pressure from about 10 to about 20 atmospheres and the temperature from about 1200° to about 1600° F. Desirably, a carbon dioxide pressure of up to 1 atmosphere is also present during the steam contacting. The $CO_2$ pressure may be generated by a partial decomposition of calcium carbonate present in standpipe 14 or carbon dioxide may be added to the steam injected through line 18. As with the calcium oxide used earlier, the synthetic acceptor of the present invention is desirably regenerated by heating the acceptor to a temperature in excess of 1800° F. thereby converting the calcium carbonate contained in the matrix to calcium oxide.

Having thus described the present invention by reference to certain of its preferred embodiments, it is respectfully pointed out that the embodiments set forth are illustrative rather than limiting in nature and that many variations and modifications are possible within the scope of the present invention. It is expected that many such variations and modifications will appear obvious and desirable to those skilled in the art based upon a review of the foregoing description of preferred embodiments.

Having thus described the present invention, I claim:

1. A synthetic $CO_2$ acceptor consisting essentially of at least one chemically uncombined calcium compound selected from the group consisting of calcium oxide and calcium carbonate supported in a refractory carrier matrix, said carrier having the general formula $$3CaO(SiO_2)_x(Al_2O_3)_{1-x}$$

wherein x is from about 0 to about 1 and wherein said chemically uncombined calcium compound is present in an amount equal to from about 10 to about 20 weight percent, calcium oxide equivalent based on the weight of the acceptor.

2. In a process for producing a synthesis gas by reacting a carbonaceous feedstock with water in the presence of a carbon dioxide acceptor to produce a synthesis gas rich in hydrogen with at least a portion of the carbon dioxide so produced being reacted with said calcium oxide to produce calcium carbonate, the improvement wherein, said $CO_2$ acceptor consists essentially of at least one chemically uncombined calcium compound selected from the group consisting essentially of calcium oxide and calcium carbonate supported in a refractory carrier matrix, said carrier having the general formula $$3CaO(SiO_2)_x(Al_2O_3)_{1-x}$$

wherein x is from about 0 to about 1 and wherein said chemically uncombined calcium compound is present in an amount equal to from about 10 to about 20 weight percent, calcium oxide equivalent based on the weight of the acceptor.

3. The improvement of claim 2 wherein said acceptor is contacted with steam at a pressure greater than 10 atmospheres and a temperature in excess of 1200° F. after at least a portion of said calcium oxide has reacted to produce calcium carbonate.

4. The improvement of claim 3 wherein said steam contacting is at a pressure from about 10 atmospheres to about 20 atmospheres and a temperature from about 1200° to about 1600° F.

5. The improvement of claim 4 wherein a $CO_2$ pressure up to about one atmosphere is present during said steam contacting.

6. The improvement of claim 2 wherein said acceptor is regenerated by heating said acceptor to a temperature in excess of 1800° F. thereby converting said calcium carbonate to calcium oxide.

* * * * *